United States Patent [19]

Whitney

[11] 4,129,970

[45] Dec. 19, 1978

[54] BUILDING CONSTRUCTION

[76] Inventor: Franklyn L. Whitney, R.D. 1, Box 447-A, Stockton, N.J. 08559

[21] Appl. No.: 851,160

[22] Filed: Nov. 14, 1977

[51] Int. Cl.[2] ..... E04B 2/08

[52] U.S. Cl. ..... 52/285; 52/461; 52/582

[58] Field of Search ..... 52/281, 282, 284, 285, 52/461, 468, 584, 582, 627

[56] References Cited

U.S. PATENT DOCUMENTS

| | | | |
|---|---|---|---|
| 2,882,564 | 4/1959 | Couse | 52/285 |
| 2,962,133 | 11/1960 | Kivett | 52/584 |
| 2,963,825 | 12/1960 | Douglas | 52/584 |
| 3,192,671 | 7/1965 | Smith | 52/282 |
| 3,378,977 | 4/1968 | Vervloet | 52/285 |
| 3,509,673 | 5/1970 | Witkosky | 52/281 |
| 3,738,083 | 6/1973 | Shimano | 52/582 |
| 3,834,101 | 9/1974 | Wilder | 52/627 |
| 4,067,161 | 1/1978 | Rensch | 52/281 |

FOREIGN PATENT DOCUMENTS

| | | | |
|---|---|---|---|
| 1026321 | 4/1953 | France | 52/285 |

*Primary Examiner*—Price C. Faw, Jr.

*Assistant Examiner*—Henry Raduazo

*Attorney, Agent, or Firm*—Dann, Dorfman, Herrell and Skillman

[57] ABSTRACT

A building construction in which a unit of the building is composed of wall and roof sections, at least some of which are sandwich panels having surface sheets disposed in spaced relation with an insulating material therebetween. Each panel is provided with a framing element extending about the periphery, the element being of U-shaped cross-section to telescopically engage over the edges of the panel with opposite legs disposed flush against the surface sheets of the panel and a transverse leg defining the edge of the panel. The three legs of the U-shaped framing element are identical in exterior configuration to permit connection of adjacent panels to any one of the three legs interchangeably. The interconnection is preferably accomplished by L-shaped clips which dispose adjacent panels in closely-adjacent spaced relation to provide a channel way between the panels, the opposite sides of the channel way being covered by cover strips which snap into place and cover the space between the legs of the framing elements in adjacent panels.

12 Claims, 10 Drawing Figures

BUILDING CONSTRUCTION

The present invention relates to building construction, and has particular application to the construction of building modules which are made up of pre-formed panels which are adapted to be interconnected by relatively unskilled operators, preferably at the building site. In particular, the present invention provides a novel edge construction for modular panels which facilitates their interconnection and enables erection of building units by relatively unskilled operators.

The present invention provides a building construction which may be designed for erection at remote locations where the availability of skilled labor is limited and where it is desirable to minimize the amount of structural work which must be performed at the construction site. The invention is particularly applicable to building units which are of the pre-cut or prefabricated type in which the various elements of the building unit are prepared at the factory for simple assembly into a unit at the construction site, the assembly operation being simplified to avoid the requirement for skilled technicians at the construction site and permitting the use of relatively unskilled labor to perform the erection and assembly of the building unit.

The present invention is particularly applicable to building panels wherein the electrical and mechanical fixtures associated with the building unit are built into the panel assemblies in a manner such that the panel assemblies may be erected and joined, and the proper mechanical or electrical connections may be made at the construction site, for example by quick-connect fittings or the like.

With the foregoing in mind, the present invention provides an edge construction for panel assemblies which facilitates rapid and secure interconnection of the panel members while providing channel ways for the mechanical and electrical connections for the fixtures in the panels.

More particular, the present invention provides an edge construction for modular panels which is architecturally sound, both from an aesthetic appearance and from consideration of structural integrity.

The modular panels of the present invention preferably comprise sandwich panels having rigid reinforced sheet elements on the opposite surfaces thereof and insulating filler material disposed therebetween. The sheet elements are preferably heat and moisture-resistant so as to isolate the insulating material between the sheets from the effect of moisture. The panel construction is preferably a thermosetting or thermoplastic material which may be fabricated in continuous lengths of a width suitable for the assembly into room-size building panels.

In accordance with the present invention, the plastic panel members are encircled about their peripheral edge with a reinforcing edge construction forming a rigid frame which not only reinforces the sandwich panel, but also provides a structural framework for the building unit.

The edge construction of the present invention is provided by an elongated structural member of U-shaped cross-section which extends about the periphery of the panel and which is preferably formed by continuous-length extrusions extending along each edge of the panel about the entire periphery.

In accordance with another feature of the invention, interconnecting clips are provided in association with the U-shaped members to interconnect the panels in endwise-spaced relation to provide channel ways therebetween in which may be disposed mechanical and electrical connections for the fixtures associated with the panel members. The interconnecting elements include also cover strips which are releasably engaged with the respective panels to span therebetween and to enclose the channel ways for the connections, said cover strips being releasable to afford exposure of the channel ways when desired for maintenance operations.

All of the objects of the invention are more fully set forth hereinafter with reference to the accompanying drawing, wherein.

Figure 1:
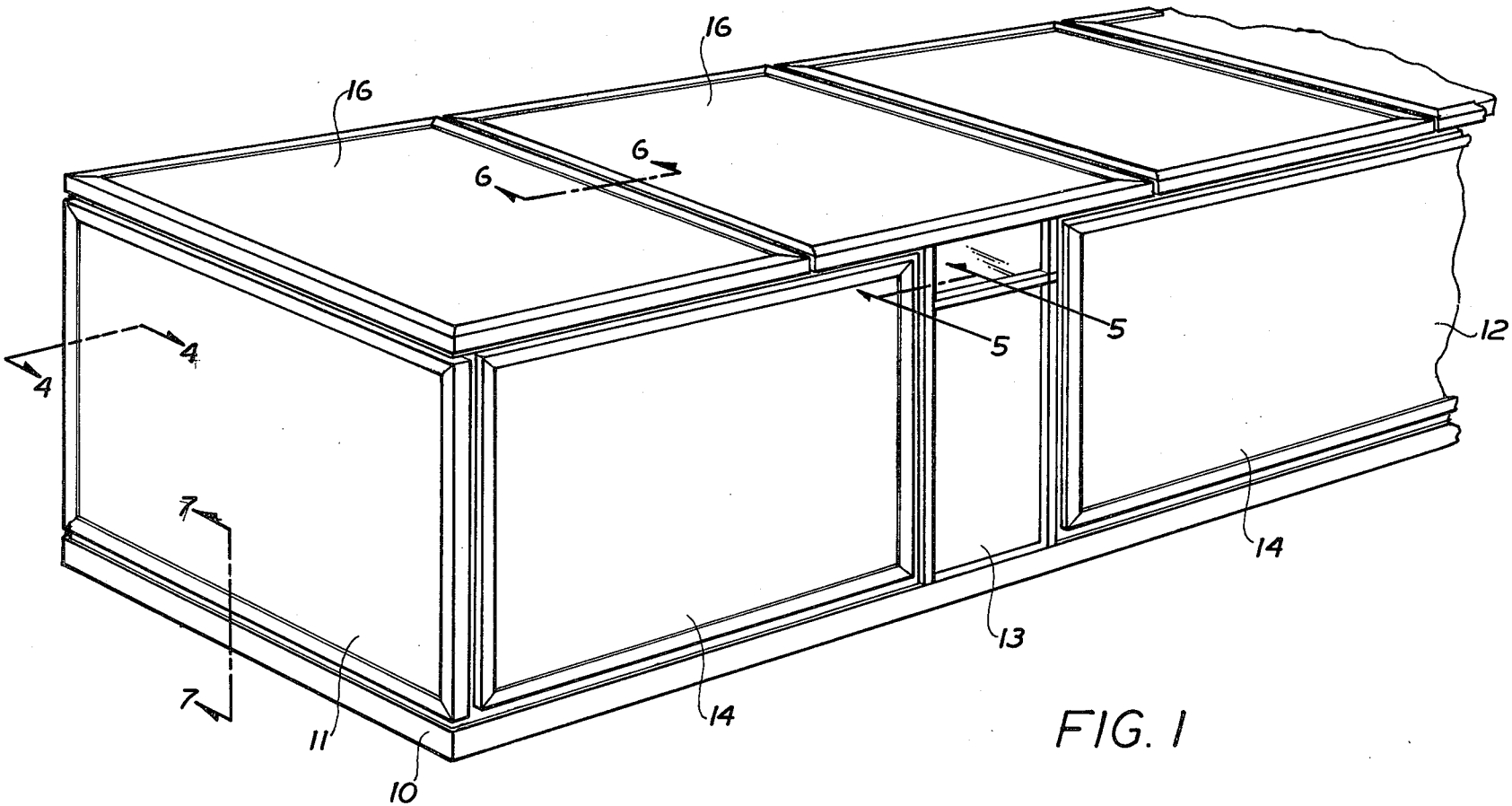
FIG. 1 shows a building unit embodying panel construction in accordance with the present invention.
Figure 8:
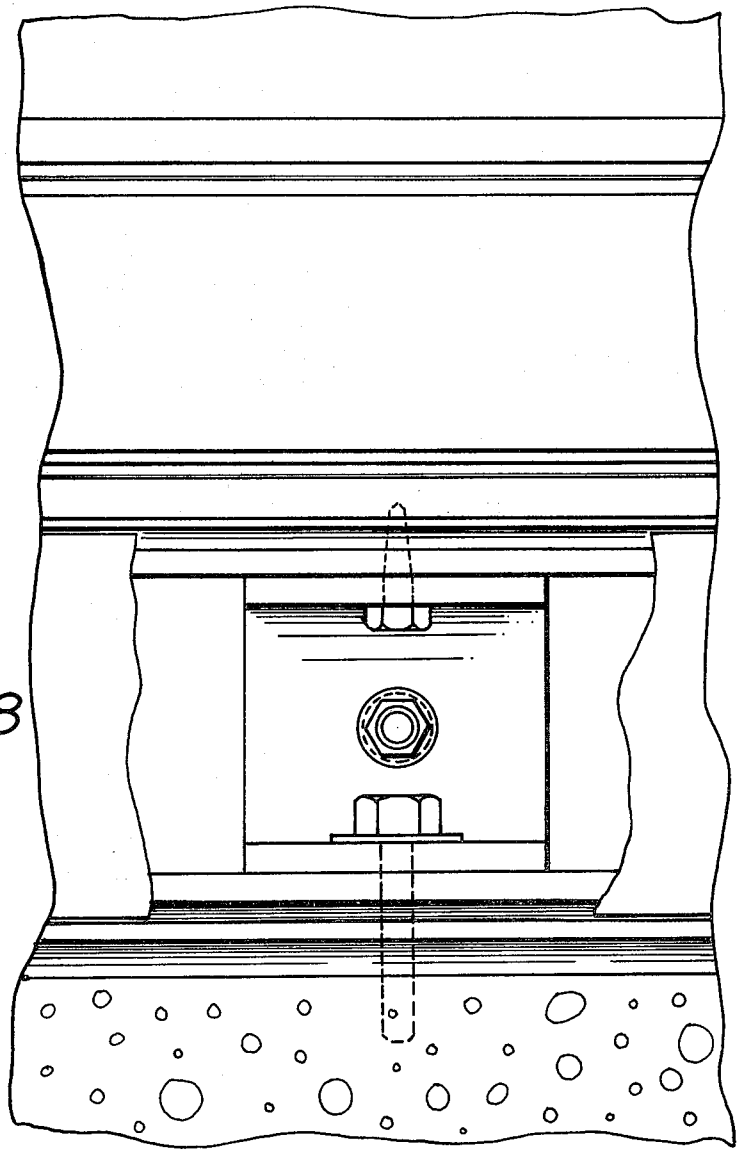
Figure 7:
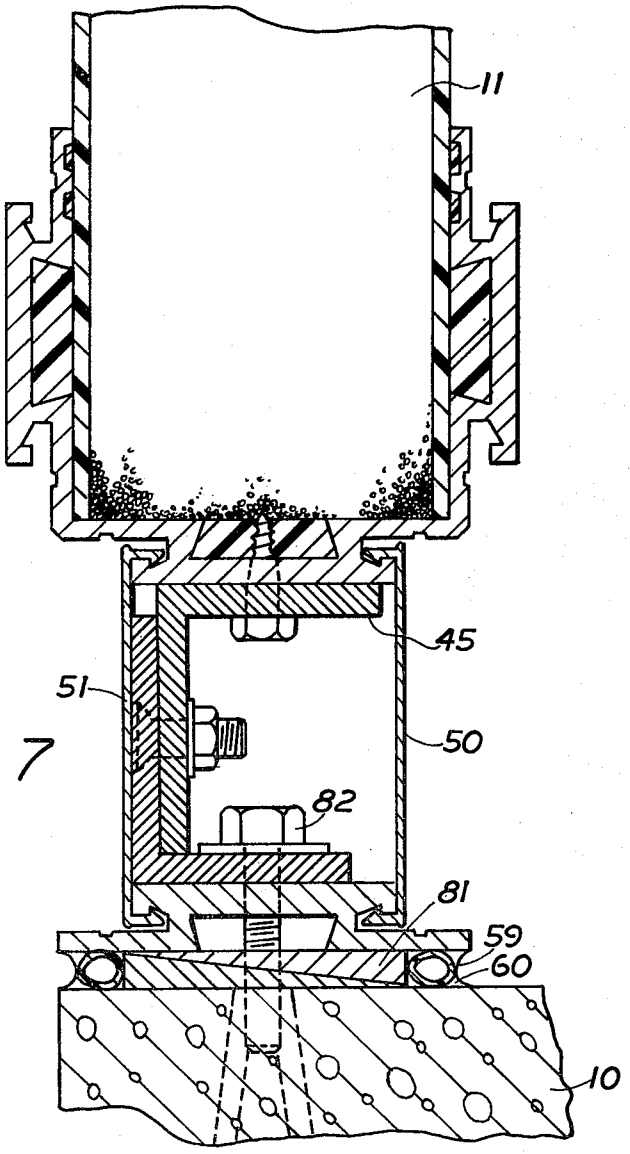
Figure 10:
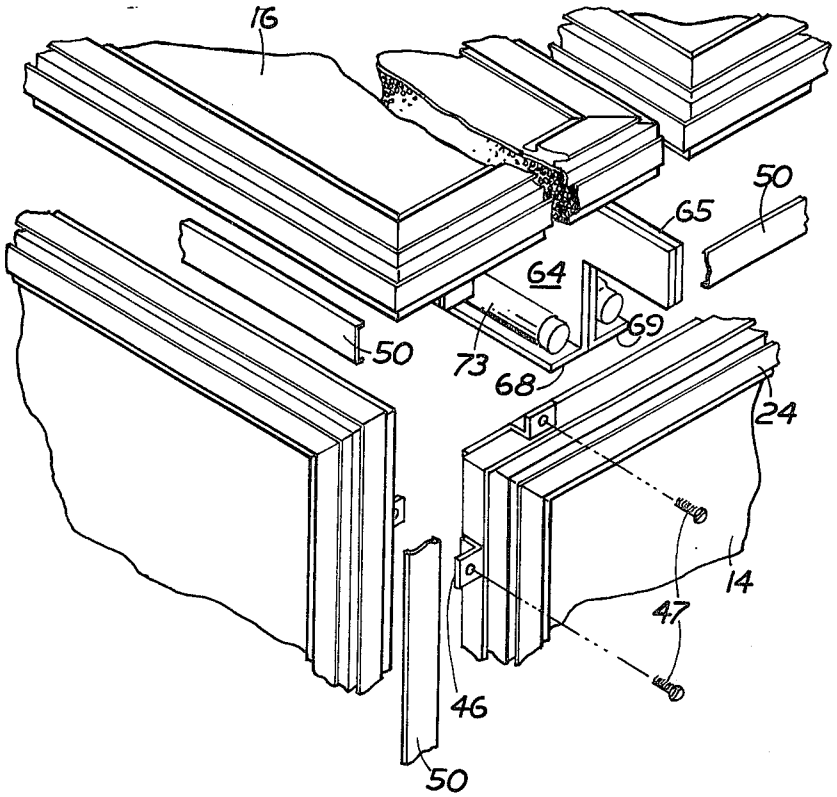
Figure 9:
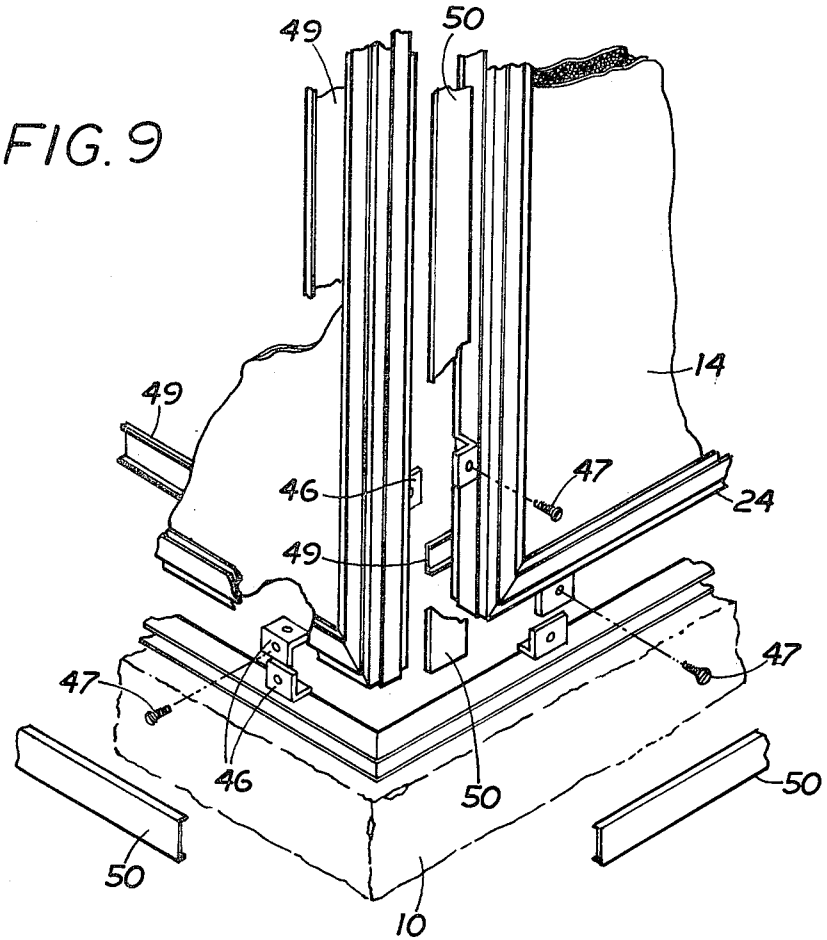

FIGS. 4, 5, 6 and 7, respectively, are sectional views taken on the corresponding section lines indicated in FIG. 1 illustrating other configurations of connections between adjacent panels;

FIG. 8 is an elevational view with a portion broken away showing a detail of the interconnection shown in FIG. 7; and FIGS. 9 and 10 are exploded perspective views showing the assembly of a lower and upper corner, respectively, of the building unit shown in FIG. 1.

Referring now to the drawing, FIG. 1 illustrates an embodiment of a building unit in which a building unit is erected on a slab 10 of concrete or other suitable material. The building unit comprises an end wall 11 and a side wall 12 having a window wall section 13 disposed therein along its length between the solid panels 14. The top of the unit is closed by a series of roof panels 16 which span between the side wall 12 and a parallel side wall panel 17 (not seen in FIG. 1) at the other side of the end wall panel 11.

Figure 2:
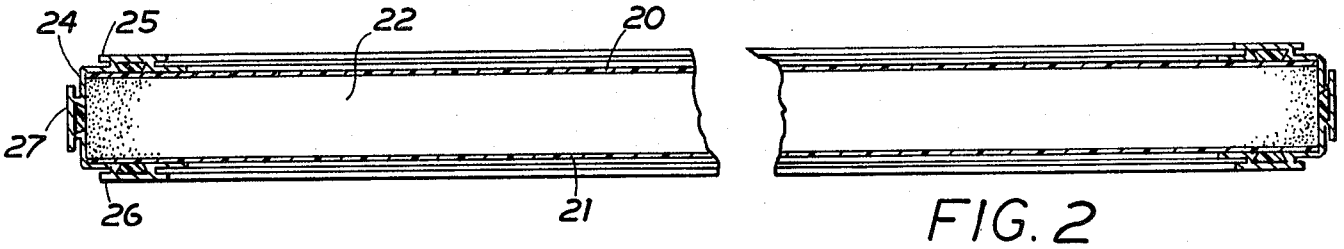
FIG. 2 is a transverse sectional view with a portion broken away illustrating a panel element embodying the edge construction of the present invention.

In the present instance, the panels 11, 14, 16 and 17 are of identical construction, and differ only in their respective dimensions. Preferably in any given installation, all of the panels will be of similar thickness and will be of uniform width. For example, as shown in FIG. 2, each panel element comprises a pair of surface sheets 20 and 21 which, preferably, are in the form of plastic sheets reinforced with fiberglass which have high impact resistance and are impermeable to moisture, for example a polyester resin. Between the reinforced plastic sheets 20 and 21, the panel is filled with a foam plastic material, such as a urethane foam. The thickness of the sandwich panel provided by the polyester sheets 20 and 21 and the polyurethane foam 22 therebetween is accurately controlled to provide a uniform thickness, for example 2½ inches. This material is preferably formed in panels which are of uniform width, for example 10 feet, for ease of handling and shipping. When erected with the width dimension vertical, the panels provide a room height within the assembled unit of a convenient size to accommodate the normal furnishing, whether it be office equipment, laboratory equipment, or living or storage accommodations. The length of each panel may vary in accordance with the design of the building unit for which the panel is constructed and the capacity of the carrier in which the panel is to be shipped. In a typical building unit, the panels will have a length corresponding to the length of the rooms embodied in the building unit although it is possible that a single panel may extend along the length of several rooms, or the length of one room may include a plurality of panels or other wall sections, if desired.

In accordance with the present invention, as shown in FIG. 2, the panel is provided about its periphery with a frame which serves as a structural reinforcement for the panel and which provides the simple and efficient interconnection of the panels at the building site. As shown, the frame comprises a U-shaped member 24 which telescopically engages over the free edges of the panel about its entire periphery. The U-shaped frame member 24 has an outside leg 25, an inside leg 26 and a transverse leg 27. As best shown in FIGS. 3–7, the legs 25, 26 and 27 are substantially similar in configuration on their exterior surface so as to provide a universally-adaptable connection between the various panel members.

Figure 3:
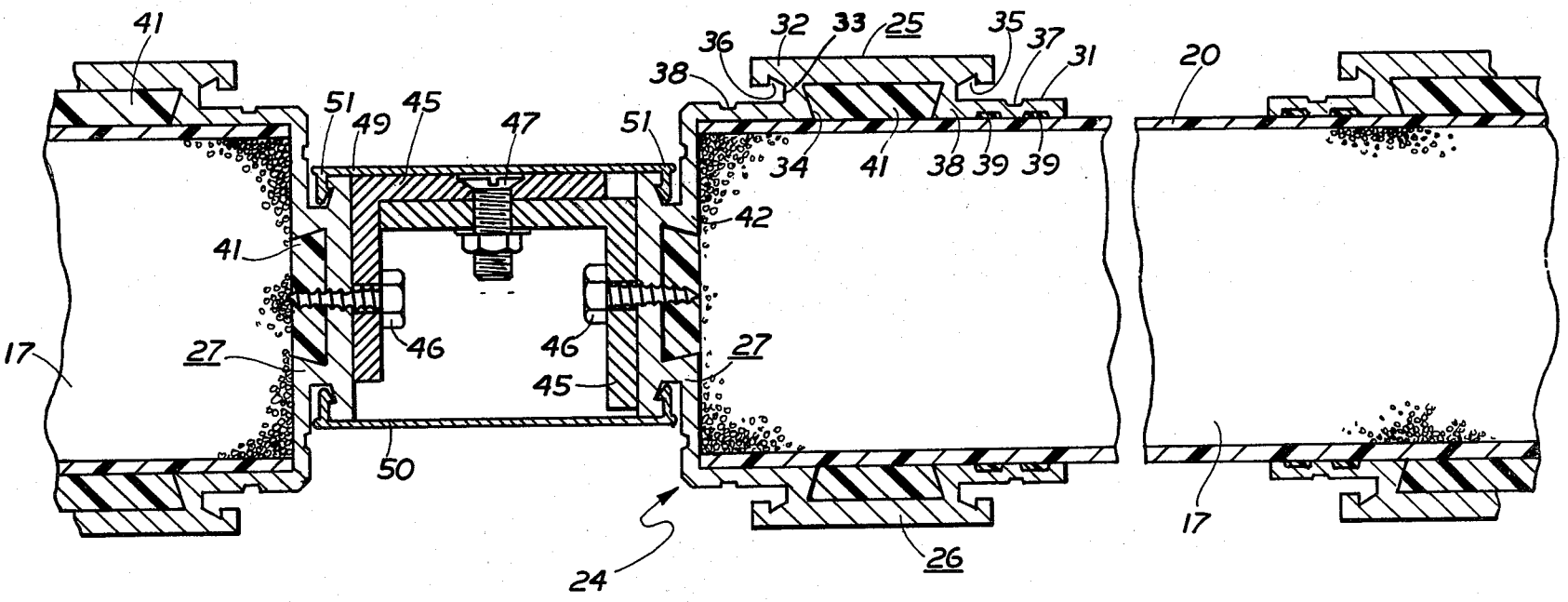
FIG. 3 is an enlarged transverse sectional view illustrating the interconnection of a pair of panel members in endwise-spaced aligned relation.

FIG. 3 shows a connection between the wall panels 17 which are hidden in FIG. 1. As shown in FIG. 3, the outside leg 25 comprises a substantially flat base portion 31 which lies flush against the sheet member 20. Spaced inwardly from the edges of the base portion 31 is a flange element 32 spaced parallel to the base portion 31 by a pedestal 33. The pedestal 33 is hollow to provide an internal recess 34 which extends along the entire length of the leg 25. The pedestal 33 is of lesser width than the flange 32 to provide undercuts 35 and 36 on opposite sides of the flange, the undercuts having a tapered anchor groove therein, as shown in FIG. 3. The outer surface of the base portion 31 is provided with positioning grooves 37 and 38 outwardly of the flange 32 which, as described more fully hereinafter, enable the unskilled operator to determine when the elements are properly assembled.

Means is provided to securely fasten the frame element 24 to the sandwich panel. On the underside of the base portion 31, the leg 25 is provided with bonding grooves 39 which are disposed parallel to and closely adjacent to the free edge of the leg 25. The hollow portion 34 of the pedestal and the grooves 39 provide channels or receptacles in which an adhesive bonding agent 41 may reside to adhesively bond the leg 25 to the sheet element 20. With reference to FIG. 3, it is noted that the leg 26 is formed identically to the leg 25 and provides comparable structural configurations. The transverse leg 27, on the other hand, has a similar exterior configuration to the legs 25 and 26, but the undersurface of the base portion 42 has no need for the grooves comparable to the grooves 39 and such grooves are not present. The bonding agent between the base 42 and the foamed filler 22 may either penetrate into the pores of the foamed material as shown, or may bond to the foamed material into a surface-to-surface bond, depending on the respective characteristics of the foamed material 22 and the bonding agent 41. It has been found that the grooves 39 and the hollow pedestal 34 provide a sufficient receptacle for the bonding agent 41 that a permanent and secure bond is achieved without supplemental anchoring devices. However, mechanical fasteners may be used, if desired, to anchor the elements to the panels.

As shown in FIG. 1, the frame elements 24 extend about the entire periphery of each panel element and provide a rigidifying structural support for the plastic components of the panel and provide a metallic supporting structure or skeleton for the building unit. The frame elements 24 are preferably an extrusion of a metallic material such as aluminum. Aluminum is the preferred material for the frame pieces 24, not only because of its structural integrity and the facility with which it may be extruded, but also because of the decorative character of the aluminum itself. Apart from the structural strength provided by the aluminum, the aluminum is readily machined to accommodate the other elements of the edge construction for connecting the panels one with another.

FIG. 3 shows a typical connection in which a pair of panels are connected in endwise alignment in adjacently-spaced relation. The spacing between adjacent panels provides a channel way which may accommodate electrical and mechanical connections to fixtures within the panels (not shown). As shown in FIG. 3, the panels are adjoining panels 17 of a side wall construction. The panels 17 are interconnected as shown by mounting clips 45 connected respectively to the transverse legs 27 of the two panel frame elements 24. The clips 45 are connected to the legs 27, for example by metal screws 46, although other fasteners may be used with good effect. The clips 45 are positioned to overlap one another as shown so that they may be interconnected by a suitable fastener 47 passing through the projecting legs thereof. Each clip 45 is an L-shaped right-angle member having one leg flush against the leg 27 and the other leg projecting outwardly therefrom at right angles. The outwardly projecting legs of the two clips are interconnected, as shown, in the present instance by a countersunk bolt 47. As shown, the angular form of the clips 45 provides an opening 48 between the clips which opening forms a channel way in which conduits or other mechanical or electrical connections may be laid. In the present instance, the clips have equal leg length so that the clips normally provide a channel way corresponding in width to the width of the sandwich panel.

The clips are mounted at suitably spaced locations along the length of the confronting edges of the panels 17 to provide sufficient structural interconnection to support the two panels in their closely-spaced-apart relation. The channel way 48 is enclosed by cover strips 49 and 50 on the inside and outside of the assembly. The cover strips preferably are coextensive in length with the width of the panels which are connected end-to-end so that the strip provides an architecturally aesthetic appearance to the connection. As shown, the cover strip 49 is substantially flat in its exterior surface and has a pair of locking legs 51,51 along opposite edges thereof, the free ends of the legs 51 having toes engaging in the tapered grooves in the undercuts 35 and 36 of the flange 32. The cover strip 49 is preferably of a rigid resilient vinyl material which snaps into place into the recesses 35 and 36. Alternatively, the cover strip 49 may be fabricated from aluminum or other metallic material which provides the desired resilient interlock with the tapered undercuts 35 and 36 to lock the strip in place.

As shown in FIG. 3, when the cover strip 49 is interlocked with the tapered undercuts 35 and 36, the planar body portions of the strips are disposed flush against the clips 45 and span between the end edges of the flanges 32 of the confronting transverse leg portions 27. The guide grooves 38 in the outer surface of the base portion of the transverse leg 27 provide a visual indication that the cover strip 49 is properly interlocked with the undercut portions 35 and 36. In other words, when the cover strip is snapped into place, the guide grooves 37 and 38 do not become visible until the cover strip is firmly and properly engaged in place. Thus, a rapid visual inspection of the connection will reveal whether or not the cover strip 49 is properly interlocked. The same condition exists on the opposite side of the interconnection, although the cover strip 50 spans between the edge portions of the flanges 32 without any intermediate support, as for example by the clip 45. It is preferred that all of the clips 45 are mounted with their extending legs aligned with the same end edges of the flanges 32 of the legs 27 so that wires or other mechanical connectors may be simply laid into the channel way 48 without need for threading the wires between clips, although for some installations it may be desired to position the clips altenately at opposite sides of the flanges 32 so as to provide a structural retainer for the elements disposed within the channel 48 beyond the retention provided by the snap-on cover strip 50.

The connectors for the fixtures may be built into the panels during their fabrication and the connectors may extend through the insulating material 22, or may be surface-mounted on the panels. For certain fixtures, it may be desirable to provide a different panel configuration and such fixtures may be embodied in a separate wall section which may be assembled with panel members in the same manner as the window wall section 13 is connected to the panels 14, as shown in FIG. 5.

Figure 4:
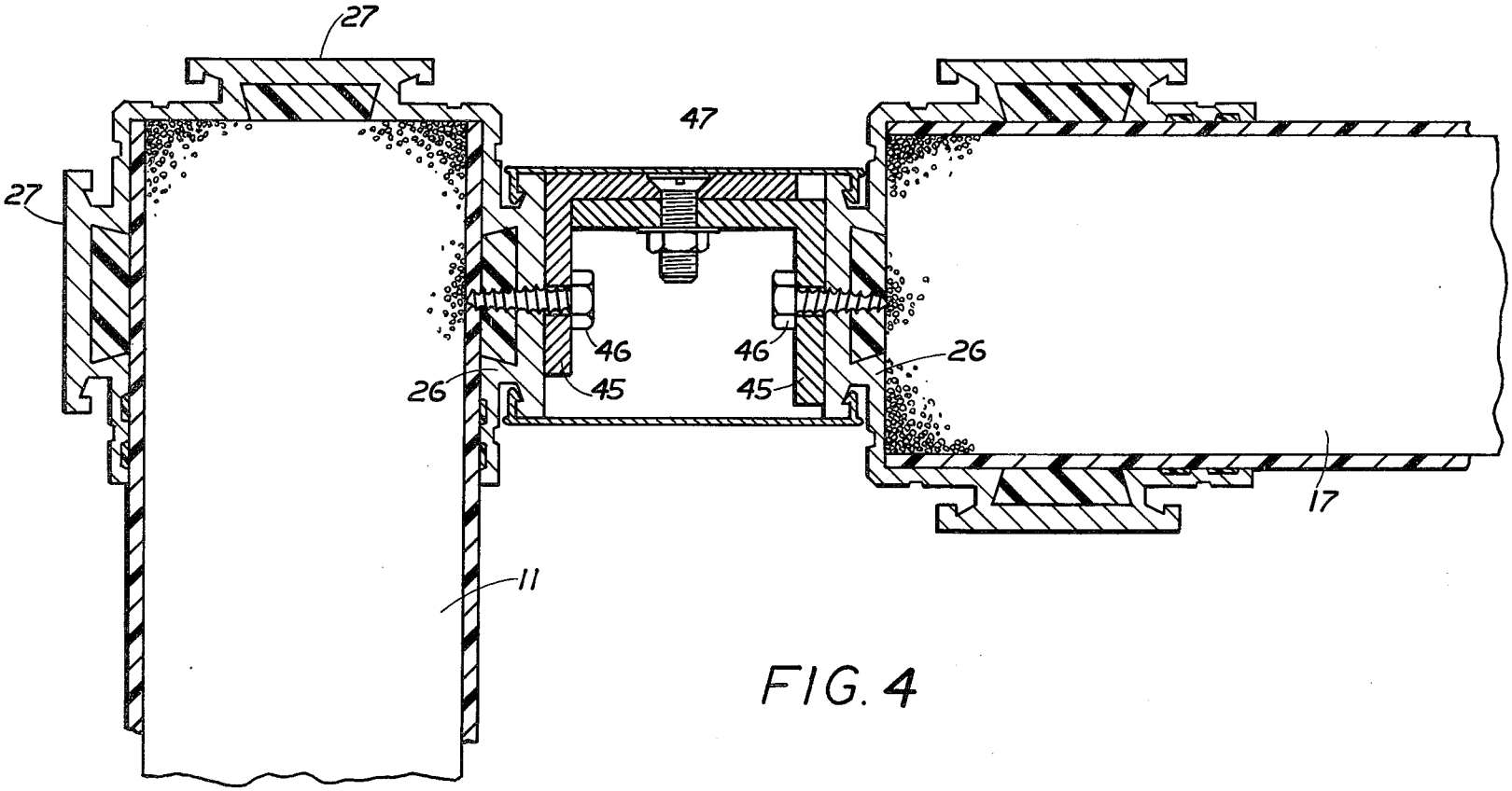

The uniformity among the legs 25, 26 and 27 of the frame member 24 permits the panels to be assembled in endwise aligned relation, as shown in FIG. 3, as well as in right-angle relation, as shown in FIG. 4. FIG. 4 shows a connection between the hidden wall panel 17 and the end wall panel 11. The panels 11 and 17 have frame members 24 which are identical to the frame members 24 described in connection with FIG. 3, including outside legs 25, inside legs 26 and transverse legs 27. In the present instance, the corner of the building unit is formed by interconnecting the transverse leg 27 of the panel 17 with the inside leg 26 of the panel 11. This connection is effected by clips 45 and fasteners 46 and 47 in a manner identical to the connection shown in FIG. 3. By connecting the panels 11 and 17 in this manner, the transverse leg 27 of the panel 11 remains exposed so that the building unit may be extended or added-to by mounting an additional panel, or a complete unit if desired, to the panel 11 by means of the transverse leg 27.

Figure 5:
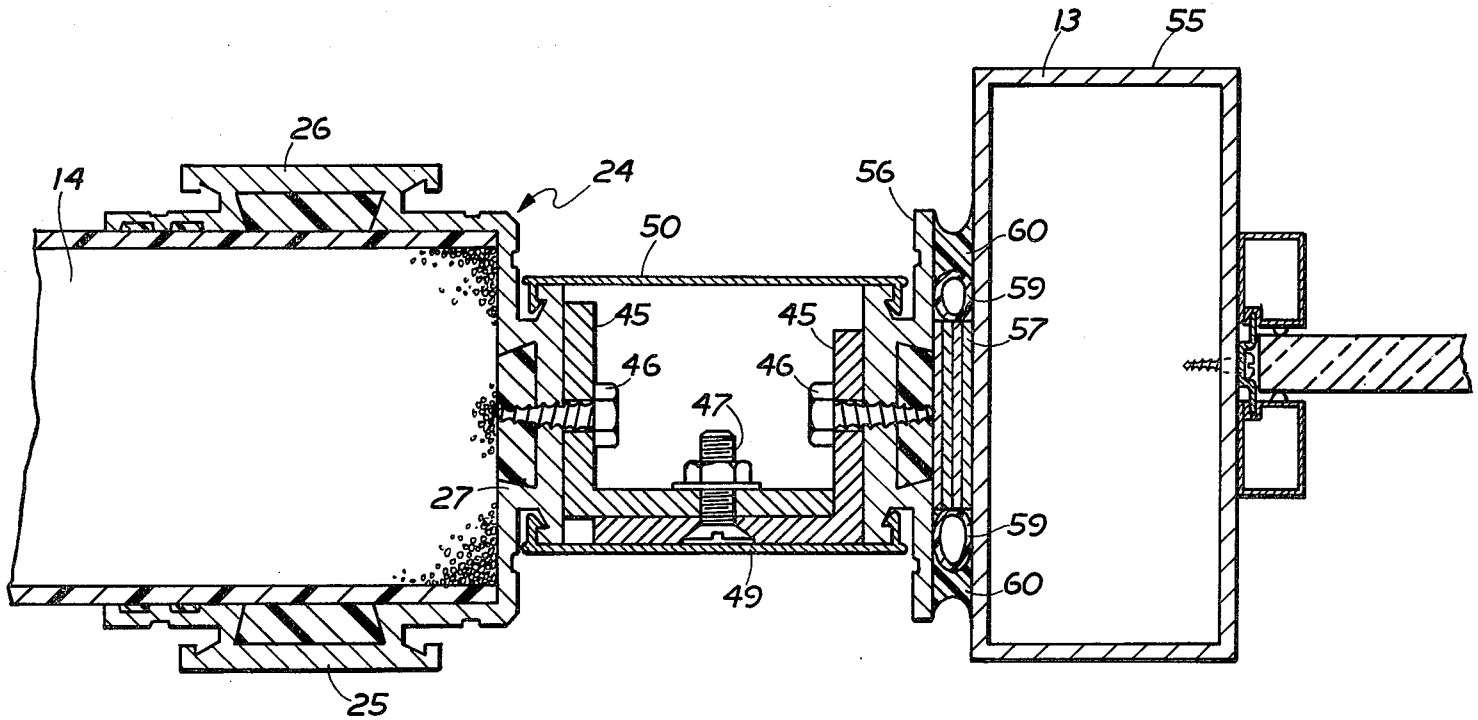

FIG. 5 illustrates the interconnection between the panel 14 and the window wall section 13. It is noted that the wall section 14 has a frame member 24 with an outside leg 25, an inside leg 26 and a transverse leg 27, all as described above in connection with FIG. 3. The window wall section, on the other hand, is fabricated with a frame member 55 about its entire periphery. On the outer side of the frame member, a connecting leg 56 is mounted, for example by a layer of gasket material 57 and fasteners (not shown). The mounting is made weather-tight by a sealing element 59 and caulking 60. The gasket material 57 serves as a shim to properly position the leg portion 56 relative to the frame 55. It is noted that the leg 56 is identical in exterior configuration to the legs 25, 26 and 27 of the frame element 24 so that it may be connected to the frame member 24 in the same manner as described above in connection with FIGS. 3 and 4, using clips 45 and fasteners 46 and 47 and cover elements 49 and 50.

Figure 6:
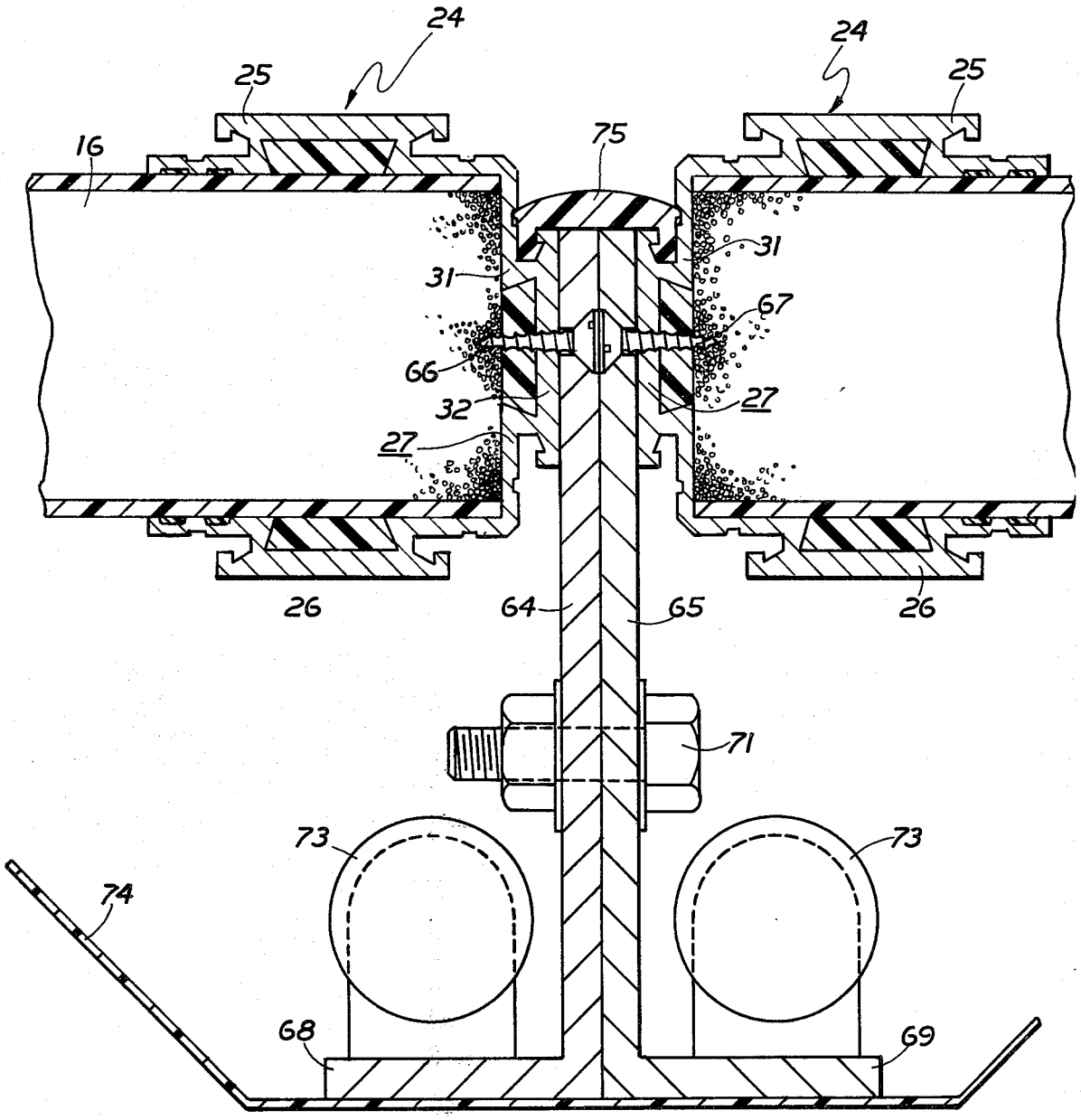

FIG. 6 shows a connection between the roof panels which differs somewhat from the connection between the wall panels and the wall sections. It is noted that the roof panels 16 are preferably of the same width as the panels 11, 14 and 17, and the length of the panels 16 corresponds to the length of the end panels 11 so that they may be mounted on the building unit in registry with the end panel 11. The connections between the edges of the roof panel 16 and the adjoining edges of the end panel 11 and the side panels 14 and 17 are identical to the right-angle connections described above in connection with FIG. 4. However, the connections between adjacent roof panels are of a different form in order to provide a further structural support for spanning the distance between the panels 14 and 17. To this end, as shown in FIG. 6, the roof panels 16 have frame members 24 identical to the frame members 24 of the other panels, including an outside leg 25, an inside leg 26 and a transverse leg 27. The transverse legs 27 of adjacent roof panels are connected together by the use of angle girders 64 and 65 which extend continuously across the full width of the building unit and along the entire length of the roof panels 16. The angle girder 64 is secured to the transverse leg 27 of the panel 16 by a series of fasteners 66 so that the leg portion of the girder 64 bears flush against the flange 32 of the leg 27. The angle member is positioned so that its flanged distal end 68 hangs below the roof panel 16 and underlies the frame element 24 of the panel 16. The angle girder 65 is likewise attached to the other panel 16 by a fastener 67 and its end portion 69 depends below the frame elements 24. The panels are interconnected by a fastener 71 which passes through the upright legs of the girders 64 and 65 and securely mounts the girders in face-to-face confronting relation. There is a series of such fasteners 71 extending the full length of the joint to insure a strong and rigid support for the roof panels between the side structures provided by the panels 14 and 17.

As shown in FIG. 6, the distal end portions 68 and 69 of the angle girders 64 and 65 permit the mounting of fixtures against the ceiling of the building unit, in the present instance the fixtures comprising tubular light elements 73 and a diffuser 74. Obviously, air conduits or other fixtures or furnishings may be mounted on the support provided by the girder elements 64 and 65. If found desirable, the distal end portions 68 and 69 may be omitted or modified to accommodate cover elements enclosing the girders (not shown). To insure a weather-tight joint between the roof panels 16, suitable caulking or other sealant is provided in the space between the base portions 31 of the legs 27, as shown at 75. The sealing material engages in the grooved undercuts of the flanges 32 to provide a firm interlock and a good seal.

At the base of the panels 11, 14 and 17, they are anchored to the slab 10, as shown in FIG. 7. Preferably, the slab 10 has a base plate 81 mounted thereon to define the perimeter of the unit and a mounting leg 56 of the same form as shown in FIG. 5 is mounted on the base plate and sealed thereon by sealing elements 59 and caulking 60. Clips 45 are mounted on the leg 56 and the corresponding leg 27 of the panel 11 to provide an interconnection which is functionally comparable to the interconnections described above in connection with FIGS. 3, 4 and 5. In the present instance, the fastener which fastens the clips 45 to the leg 57 is an expansion bolt 82 rather than a metal screw 46 as described above.

The clips 45 provide a channel way about the entire periphery of the building unit which is enclosed by the cover strips 50 on the inside and outside of the unit. The overall assembly of the unit is readily understood by reference to FIGS. 9 and 10 which show exploded views of the building unit in the process of assembly.

The building construction of the present invention is particularly suitable for use where there is a scarcity of skilled construction workers. The construction of the present invention enables the components of the building to be manufactured at a remote location and shipped to the building site in a knocked-down condition. The clips and other fasteners may be installed on the panels at the building site or the clips may be installed at the factory so that the erection only requires the insertion of the fasteners and the application of the seals to the joints. With the clips and other fasteners attached at the factory, the building may be pre-assembled and tested at the factory and then knocked-down for shipment to the building site. The versatile nature of the building construction permits wide variations in the manner in which the building is erected, accommodating to the conditions at the building site.

While a particular embodiment of the present invention has been herein illustrated and described, it is not intended to limit the invention to such disclosure, but changes and modifications may be made therein and thereto within the scope of the following claims.

I claim:

1. In a building unit having a plurality of panels interconnected to comprise a building module, a sandwich panel having a pair of spaced parallel surface sheets and an intermediate filler material, and a reinforcing, load-carrying framing element extending about the periphery of said sandwich panel, said framing element comprising an elongated member of generally U-shaped cross-section having spaced parallel extending leg portions and an intermediate transverse leg portion, each of said three leg portions having a wide base portion, and a flange portion mounted in outwardly-spaced-parallel relation to said base portion by a pedestal, the width of said pedestal being less than the width of said flange portion to provide clearance between the inner side of each free margin of the flange and the outer side of the base portion confronting said flange, the extending leg portions being mounted with the inner surface of said base disposed flush against the exposed surface sheet of said sandwich panel, and means to anchor said U-shaped member in place.

2. A sandwich panel according to claim 1 wherein said anchoring means comprises a bonding agent disposed between said extending leg portions and said surface sheets.

3. A sandwich panel according to claim 2 wherein said pedestal is hollow to provide a receptacle for the bonding agent on the underside of said wide base portion.

4. A sandwich panel according to claim 2 wherein the undersides of said base portions have grooves adjacent the free edge thereof to provide receptacles for the bonding agent.

5. In combination with a sandwich panel according to claim 1 a wall section adapted for connection thereto comprising an elongated member with a transverse leg portion having a wide base portion extending along the edge of the wall section, a flange portion parallel to said base portion in outwardly-spaced relation thereto, a pedestal mounting said flange portion on said base portion to provide clearance between the inner side of each free margin of the flange and the outer side of the base portion confronting said flange, means mounting said wall section adjacent said sandwich panel with the flange portion of the wall section in closely-spaced confronting parallel relation to one of the flange portions of said sandwich panel, and a pair of cover strips engaging in the clearance spaces and spanning between the edges of the confronting flanges to form an enclosed channel way having a pair of opposite sides defined by said flanges and another pair of opposite sides defined by said cover strips.

6. A combination according to claim 5 wherein each of said cover strips comprises a planar body portion and a pair of legs, each of which is adapted to snap into the clearance space between the flange and the base portion.

7. A building unit having a plurality of panels interconnected to comprise a building module, each of said panels having a pair of spaced parallel surface sheets and an intermediate filler material, a reinforcing load-carrying framing element extending about the periphery of each of said panels, said framing element comprising an elongated member of generally U-shaped cross-section having spaced parallel extending leg portions and an intermediate transverse leg portion, each of said three leg portions having undercut recesses extending along opposite sides of said leg portion along the entire length of said framing element and means mounting said framing element in telescopic engagement with said panel to overlie the marginal edges of said panels, said extending leg portions overlying each of said opposite parallel surface sheets and said transverse leg portion spanning between said parallel sheets to define the edge of said panel, and means interconnecting said panels comprising angular clip elements disposed at spaced locations along the length of said panels having one part anchored to one of said three leg portions of one panel and an angular part extending at right angles to said leg portion, a second clip member having one part firmly anchored to one of said three leg portions of an adjacent panel and another part extending at right angles thereto, said extending part of said clips being disposed in face-to-face abutting relation, and releasable fastener means interconnecting said extending parts and effecting interconnection of said panel members.

8. A building construction according to claim 7 wherein the panels are disposed in a hollow rectangular array to constitute a building module and including a roof structure composed of a plurality of said sandwich panels extending longitudinally across the width of said building unit, said sandwich panels of the roof structure being connected to the panels forming the wall structure by clips and fasteners, the panels of the roof structure being interconnected by a first girder member connected to the transverse leg of one roof panel and projecting perpendicularly downard therefrom, a second girder member connected to the transverse leg of the adjacent roof panel and projecting perpendicularly downward therefrom, and fastener means for connecting said two girder members in face-to-face abutting relation, said girder members longitudinally spanning the full width of the building unit.

9. A building construction according to claim 8 wherein each of said girder members has at its distal edge an angular flange extending to underlie its associated panel member, the flanges of the two girder members being aligned to provide a support structure underlying said roof.

10. A building construction according to claim 7 wherein said connecting elements include cover strips spanning between said adjacent panels, said cover strips having leg portions adapted to engage in said longitudinally extending undercut recesses of the legs of the adjacent panels to enclose the space between said panels provided by clip members.

11. A building construction according to claim 10 wherein said legs have guide grooves positioned therein parallel to said channels in a position to be exposed adjacent said cover strips when said cover strips are properly engaged in said channels.

12. A building construction according to claim 11 wherein said cover strips are formed of a resilient material to permit the legs thereof to snap into engagement with said channels.

* * * * *